US010687555B2

(12) United States Patent
Buchberger et al.

(10) Patent No.: US 10,687,555 B2
(45) Date of Patent: Jun. 23, 2020

(54) VAPORIZER ASSEMBLY HAVING A VAPORIZER AND A MATRIX

(71) Applicant: BATMARK LIMITED, London (GB)

(72) Inventors: Helmut Buchberger, St. Florian (AT); Colin John Dickens, London (GB)

(73) Assignee: BATMARK LIMITED, London (GB)

( * ) Notice: Subject to any disclaimer, the term of this patent is extended or adjusted under 35 U.S.C. 154(b) by 0 days.

(21) Appl. No.: 15/322,221

(22) PCT Filed: Jun. 25, 2015

(86) PCT No.: PCT/GB2015/051845
§ 371 (c)(1),
(2) Date: Dec. 27, 2016

(87) PCT Pub. No.: WO2015/198049
PCT Pub. Date: Dec. 30, 2015

(65) Prior Publication Data

US 2017/0127725 A1 May 11, 2017

(30) Foreign Application Priority Data

Jun. 27, 2014 (GB) ..... 1411483.9

(51) Int. Cl.

| | |
|---|---|
| ***A24F 13/00*** | (2006.01) |
| ***A24F 17/00*** | (2006.01) |
| ***A24F 25/00*** | (2006.01) |
| ***A24F 47/00*** | (2020.01) |
| ***H05B 1/02*** | (2006.01) |

(52) U.S. Cl.
CPC ..... *A24F 47/008* (2013.01); *H05B 1/0244* (2013.01); *H05B 2203/021* (2013.01)

(58) Field of Classification Search
CPC ..... A24F 47/008; A24F 47/002; A61M 11/00; A61M 15/00
USPC ..... 131/329, 328
See application file for complete search history.

(56) References Cited

U.S. PATENT DOCUMENTS

| | | | |
|---|---|---|---|
| 4,223,292 | A | 9/1980 | Morikawa |
| 4,588,976 | A | 5/1986 | Jaselli |
| 4,735,217 | A | 4/1988 | Gerth |
| 4,922,901 | A | 5/1990 | Brooks |

(Continued)

FOREIGN PATENT DOCUMENTS

| | | |
|---|---|---|
| CN | 201375023 Y | 1/2010 |
| CN | 201767029 | 3/2011 |

(Continued)

OTHER PUBLICATIONS

International Search Report for corresponding International Application No. PCT/GB2015/051845 dated Sep. 30, 2015; 3 pages.

(Continued)

*Primary Examiner* — Abdullah A Riyami
*Assistant Examiner* — Thang H Nguyen
(74) *Attorney, Agent, or Firm* — Patterson Thuente Pedersen, P.A.

(57) ABSTRACT

A vaporizer assembly comprising a vaporizer and a matrix suitable for retaining a vaporizable liquid, wherein the vaporizer includes first and second surfaces forming a common edge, the first surface having a greater surface area than the second surface, wherein the vaporizer is in contact with the matrix via the second surface.

24 Claims, 12 Drawing Sheets

(56) References Cited

U.S. PATENT DOCUMENTS

| | | | | |
|---|---|---|---|---|
| 5,060,671 | A | 10/1991 | Counts | |
| 5,095,921 | A | 3/1992 | Losee | |
| 5,179,966 | A | 1/1993 | Losee | |
| 5,222,362 | A | 6/1993 | Maus | |
| 5,322,075 | A | 6/1994 | Deevi | |
| 5,530,225 | A | 6/1996 | Hajaligol | |
| 5,613,505 | A | 3/1997 | Campbell | |
| 5,666,978 | A | 9/1997 | Counts | |
| 5,692,525 | A | 12/1997 | Counts | |
| 5,771,845 | A | 6/1998 | Pistien | |
| 6,124,579 | A | 9/2000 | Steinhauser | |
| 6,155,268 | A | 12/2000 | Takeuchi | |
| 6,598,607 | B2 * | 7/2003 | Adiga | A24F 47/004 131/194 |
| 6,671,450 | B2 | 12/2003 | Khan | |
| 7,374,063 | B2 | 5/2008 | Reid | |
| 8,156,944 | B2 | 4/2012 | Han | |
| 8,365,742 | B2 | 2/2013 | Hon | |
| 8,375,957 | B2 | 2/2013 | Hon | |
| 8,393,331 | B2 | 3/2013 | Hon | |
| 8,752,545 | B2 | 6/2014 | Buchberger | |
| 8,833,364 | B2 | 9/2014 | Buchberger | |
| 8,948,578 | B2 | 2/2015 | Buchberger | |
| 9,555,199 | B2 | 1/2017 | Buchberger | |
| 9,572,373 | B2 * | 2/2017 | Chen | A24F 47/008 |
| 2002/0113685 | A1 | 8/2002 | Izaki | |
| 2003/0049025 | A1 | 3/2003 | Neumann | |
| 2003/0186474 | A1 | 10/2003 | Haluzak | |
| 2004/0096204 | A1 | 5/2004 | Gerhardinger | |
| 2005/0063686 | A1 | 3/2005 | Whittle | |
| 2005/0211711 | A1 | 9/2005 | Reid | |
| 2005/0268911 | A1 | 12/2005 | Cross | |
| 2007/0047434 | A1 | 4/2007 | Braunshteyn | |
| 2007/0155255 | A1 | 7/2007 | Galauner | |
| 2008/0047956 | A1 * | 2/2008 | Dudman | A47J 36/2483 219/600 |
| 2008/0216828 | A1 | 9/2008 | Wensley | |
| 2009/0126745 | A1 | 5/2009 | Hon | |
| 2009/0220222 | A1 * | 9/2009 | Rabin | A61M 16/021 392/396 |
| 2009/0272379 | A1 | 11/2009 | Thorens | |
| 2011/0094523 | A1 | 4/2011 | Thorens | |
| 2011/0155153 | A1 | 6/2011 | Thorens | |
| 2011/0226236 | A1 * | 9/2011 | Buchberger | A61M 11/041 128/200.23 |
| 2013/0056012 | A1 | 3/2013 | Hearn | |
| 2013/0152922 | A1 | 6/2013 | Benassayag | |
| 2013/0192615 | A1 * | 8/2013 | Tucker | A61M 11/003 131/328 |
| 2013/0192623 | A1 | 8/2013 | Tucker | |
| 2013/0213419 | A1 * | 8/2013 | Tucker | H05B 3/0014 131/328 |
| 2013/0213420 | A1 | 8/2013 | Hon | |
| 2014/0000638 | A1 | 2/2014 | Sebastian | |
| 2014/0182608 | A1 | 7/2014 | Egoyants | |
| 2014/0196734 | A1 * | 7/2014 | Liu | A24F 47/008 131/329 |
| 2014/0238396 | A1 | 8/2014 | Buchberger | |
| 2014/0238422 | A1 * | 8/2014 | Plunkett | A24F 47/008 131/328 |
| 2014/0283825 | A1 | 9/2014 | Buchberger | |
| 2014/0299125 | A1 | 10/2014 | Buchberger | |
| 2014/0346689 | A1 * | 11/2014 | Dubief | A24F 47/008 261/142 |
| 2014/0353856 | A1 * | 12/2014 | Dubief | B01F 3/04078 261/128 |
| 2015/0007835 | A1 * | 1/2015 | Liu | A24F 47/008 131/329 |
| 2015/0030317 | A1 | 1/2015 | Bayer | |
| 2015/0040925 | A1 | 2/2015 | Saleem | |
| 2015/0059780 | A1 * | 3/2015 | Davis | A24F 47/008 131/328 |
| 2015/0157055 | A1 * | 6/2015 | Lord | H05B 3/16 131/329 |
| 2015/0208728 | A1 | 7/2015 | Lord | |
| 2015/0216237 | A1 * | 8/2015 | Wensley | A24F 47/008 131/273 |
| 2016/0353802 | A1 * | 12/2016 | Malgat | A61M 15/06 |
| 2017/0027225 | A1 | 2/2017 | Buchberger | |
| 2017/0027234 | A1 * | 2/2017 | Farine | A24F 47/008 |
| 2017/0188629 | A1 * | 7/2017 | Dickens | A61M 11/042 |
| 2017/0188630 | A1 | 7/2017 | Buchberger | |
| 2017/0197043 | A1 | 7/2017 | Buchberger | |
| 2017/0197044 | A1 | 7/2017 | Buchberger | |
| 2017/0197046 | A1 | 7/2017 | Buchberger | |
| 2017/0203057 | A1 | 7/2017 | Buchberger | |

FOREIGN PATENT DOCUMENTS

| | | | | |
|---|---|---|---|---|
| CN | 201830900 | | 5/2011 | |
| CN | 202354377 | | 8/2012 | |
| DE | 202012005406 | U1 | 6/2012 | |
| EP | 1736065 | B1 | 6/2009 | |
| EP | 2 110 033 | | 10/2009 | |
| EP | 2399636 | A1 | 6/2010 | |
| EP | 2316286 | | 5/2011 | |
| EP | 2340730 | A1 | 7/2011 | |
| EP | 2460424 | A1 | 6/2012 | |
| EP | 2574247 | A1 | 4/2013 | |
| EP | 20140166688 | * | 4/2014 | A24F 47/00 |
| JP | 11-89551 | | 4/1999 | |
| JP | 2009-537120 | | 10/2009 | |
| WO | WO 03/037412 | | 5/2003 | |
| WO | WO 03/103387 | | 12/2003 | |
| WO | WO2009118085 | A1 | 10/2009 | |
| WO | WO 2010/045671 | A1 | 4/2010 | |
| WO | WO2012106739 | A1 | 2/2011 | |
| WO | WO 2011/079932 | | 7/2011 | |
| WO | WO 2011/109849 | A1 | 9/2011 | |
| WO | WO 0167819 | | 9/2011 | |
| WO | WO2013057185 | A1 | 4/2013 | |
| WO | WO2013060781 | A1 | 5/2013 | |
| WO | WO2013068304 | A1 | 5/2013 | |
| WO | WO2013083634 | A1 | 6/2013 | |
| WO | WO2013083635 | A1 | 6/2013 | |
| WO | WO2013083636 | A1 | 6/2013 | |
| WO | WO 2013/098409 | A1 | 7/2013 | |
| WO | WO 2013/098410 | A2 | 7/2013 | |
| WO | WO 2013/102609 | A2 | 7/2013 | |
| WO | WO2013098395 | A1 | 7/2013 | |
| WO | WO2013098410 | A2 | 7/2013 | |
| WO | WO2013102609 | A2 | 7/2013 | |
| WO | WO2013160112 | | 10/2013 | |
| WO | WO2014037794 | A2 | 3/2014 | |
| WO | WO2014130772 | A1 | 8/2014 | |

OTHER PUBLICATIONS

Written Opinion of the International Searching Authority for corresponding International Application No. PCT/GB2015/051845 dated Sep. 30, 2015; 5 pages.

International Preliminary Report on Patentability for corresponding International Application No. PCT/GB2015/051845 dated Sep. 30, 2015; 13 pages.

X6 Atomizer / KTS Atomizer, Fly Smoker Manufacture in electric cigarette, http://www.flysmoke.com/x6-atomizer-kts-atomizer.html retrieved Sep. 3, 2013.

Great Britain Search Report, Application No. GB1411483.9, dated Dec. 22, 2014, 4 pages.

Japanese Search Report, Application No. 2016-575451, dated Nov. 27, 2017, 12 pages.

Japanese Office Action, Application No. 2016-575451, dated Dec. 5, 2017, 3 pages.

Application and File History for U.S. Appl. No. 13/583,381, filed Dec. 17, 2012, inventors Buchberger.

Application and File History for U.S. Appl. No. 15/398,981, filed Jan. 5, 2017, inventors Buchberger.

Japanese Office Action, Application No. 2015-506185, dated Sep. 29, 2015, 3 pages.

(56) References Cited

OTHER PUBLICATIONS

International Search Report and Written Opinion, Application No. pct/ep2013/057539, dated Apr. 11, 2013.
Warrier et al., "Effect of the Porous Structure of Graphite on Atomic Hydrogen Diffusion and Inventory," Nucl. Fusion 47 (2007), 1656-1663.
Davies, G.J., "Metallic Foams: Their Production, Properties and Applications," Journal of Materials Science, vol. 18, p. 1899-1911, 1983.
Canadian Office Action, Application No. 2,951,511, dated Nov. 16, 2017, 5 pages.
Chinese Office Action, Application No. 201580034426.1, dated Apr. 2, 2019, 20 pages.

* cited by examiner

VAPORIZER ASSEMBLY HAVING A VAPORIZER AND A MATRIX

CROSS-REFERENCE TO RELATED APPLICATIONS

The present application is a National Phase entry of PCT Application No. PCT/GB2015/051845, filed on 25 Jun. 2015, which claims priority to GB Patent Application No. 1411483.9, filed on 27 Jun. 2014, which are hereby fully incorporated herein by reference.

TECHNICAL FIELD

The present disclosure relates to a vaporizer assembly and devices incorporating the vaporizer assembly.

BACKGROUND

Devices such as e-cigarettes may include an assembly which is responsible for creating an aerosol which is subsequently inhaled by the user. The aerosol may be formed by vaporizing (evaporating) a suitable liquid. The vaporized liquid subsequently forms an aerosol which is then inhaled by the user. The aerosol may also be produced via mechanical means, for example by using a piezo-electric atomizer, or via a heater.

One example of a device including a vaporizer is provided in WO 2010/045671. In this device, the vaporizer may contact a liquid reservoir via the upper major surface of the vaporizer.

SUMMARY

According to a first aspect there is disclosed a vaporizer assembly comprising a vaporizer and a matrix suitable for retaining a vaporizable liquid, wherein the vaporizer comprises: first and second surfaces forming a common edge, the first surface having a greater surface area than the second surface; wherein the vaporizer is in contact with the matrix via the second surface.

According to a second aspect there is disclosed a device, such as an e-cigarette, comprising the vaporizer assembly according to the first aspect.

In a further general aspect there is disclosed a vaporizer assembly comprising a vaporizer configured to be fed with a vaporizable liquid in a direction substantially perpendicular to the longitudinal axis of the vaporizer.

The below description of the present disclosure may apply to any of the above aspects and any disclosure should not be construed as being limited to the aspect or embodiment being discussed under that particular section.

Vaporizer Assembly

As disclosed herein, a vaporizer assembly comprises a vaporizer and a matrix suitable for retaining a vaporizable liquid.

The vaporizer produces a vapor by evaporating the liquid retained in the matrix. This evaporation is carried out via heating. Therefore, the vaporizer may also be referred interchangeably to as a heater or distiller. It will be understood that following the formation of a vapor an aerosol is subsequently formed as a result of the vapor condensing. As a result, the vaporizer may also be referred to as an aerosol forming component.

The vaporizer is typically a three dimensional structure having at least first and second surfaces. The first and second surfaces form a common edge. In other words, the first surface and the second surface are arranged so that they share a common edge. The first and second surfaces may be substantially perpendicular to each other, however, it may be that the angle formed between the two surfaces is greater than or less than 90°.

Reference in the present disclosure to a surface relates to an area of the vaporizer enclosed by one or more edges. For example, where the vaporizer is substantially rectangular in shape it has a first surface and a second surface forming a common edge, the first and second surfaces being perpendicular to each other. Where the vaporizer is substantially circular (disc like) it has a first surface enclosed by a circular edge, said edge being common to the second surface which extends at an angle away from the first surface (e.g. 90°) and around the disc.

With regard to the term "edge" it is pointed out that this term encompasses rounded or chamfered edges, as well as other profiles that transition two surfaces.

The first surface has a surface area which is greater than the surface area of the second surface. As a result, it will be understood that the first surface typically forms the upper face of the vaporizer (or lower face, depending on orientation) and the second surface may then form either a side face or an end face of the vaporizer. The particular shape of the vaporizer is not, however, particularly limited and various shapes are possible, provided that the first surface and the second surface form a common edge and the surface area of the first surface is greater than that of the second surface. In one embodiment, the vaporizer is sheet-like. In one embodiment, the vaporizer is planar. Further examples of suitable vaporizer shapes and configurations are described later.

The vaporizer itself may be formed from a material having a capillary structure. In this regard, and as a result of being in contact with the matrix containing a vaporizable liquid, the capillary structure serves to distribute the liquid to be vaporized throughout the vaporizer. Accordingly, the capillary structure may extend throughout the entire vaporizer. Alternatively, it is possible that the capillary structure may be localized to specific areas of the vaporizer.

The capillary structure of the vaporizer may be exposed on at least one surface of the vaporizer. In other words, the capillary structure extends to the exterior of the vaporizer surface. Where the capillary structure is exposed on the surface of the vaporizer and is in contact with the matrix, the capillary structure serves to draw liquid from the matrix into the vaporizer. Therefore, in one embodiment, the capillary structure of the vaporizer is exposed on at least one surface of the vaporizer, such as the second surface, or any surface forming a common edge with the first surface. The capillary structure of the vaporizer may be exposed on all surfaces of the vaporizer. In one embodiment, the capillary structure of the vaporizer is exposed on at least the second surface of the vaporizer. In a preferred embodiment, the capillary structure of the vaporizer is exposed on at least the first and second surfaces of the vaporizer. In a further preferred embodiment, the capillary structure of the vaporizer is exposed on all surfaces of the vaporizer.

Where the capillary structure is exposed on multiple surfaces of the vaporizer, such as the first and second surfaces, liquid is drawn from the matrix via capillary action and vaporized by the vaporizer.

In this regard, it will be understood that the dimensions of the capillary pores in the vaporizer will be such that they are able to draw liquid from the matrix. The vaporized liquid exits the vaporizer via the portion of the capillary structure that is exposed. In this regard, it will be understood that the capillary structure of the second surface, even though exposed, is in contact with the matrix. Accordingly, vaporized liquid exits the vaporizer through those areas where the capillary structure is exposed and open to the local environment, such as a chamber within a device in which the vaporizer assembly is incorporated. Thus, reference to "exposed" in the present context does not mean that the surface containing the exposed capillary structure cannot be in contact with a component other than the vaporizer, such as the matrix. Rather, "exposed" refers to the extension of the capillary structure to the perimeter of the vaporizer so that liquid can be drawn from an external source (e.g. a matrix) into the vaporizer through the capillary structure. If the capillary structure is extending to the exterior of the vaporizer surface (considering the vaporizer only), the capillary structure can be considered to be exposed on that surface.

In certain circumstances, at least one of the surfaces of the vaporizer does not have an exposed capillary structure. This may be because the surface in question does not include a capillary structure, or it may be because the capillary structure of this surface has been completely or partially covered with another component of the vaporizer. By limiting the exposure of the capillary structure (or part thereof) to discrete areas of the vaporizer surfaces it may be possible to focus the distribution of evaporated liquid into certain areas, leading to areas of increased vapor density which may be advantageous.

The vaporizer may have any one of the following structures: a woven structure, mesh structure, fabric structure, open-pored fiber structure, open-pored sintered structure, open-pored foam or open-pored deposition structure. Said structures are suitable in particular for providing a vaporizer body with a high degree of porosity. A high degree of porosity may ensure that the heat produced by the vaporizer is predominately used for evaporating the liquid and high efficiency can be obtained. A porosity of greater than 50% may be envisaged with said structures. In one embodiment, the porosity of the vaporizer is 50% or greater, 60% or greater, 70% or greater. The open-pored fiber structure can consist, for example, of a non-woven fabric which can be arbitrarily compacted, and can additionally be sintered in order to improve the cohesion. The open-pored sintered structure can consist, for example, of a granular, fibrous or flocculent sintered composite produced by a film casting process. The open-pored deposition structure can be produced, for example, by a CVD process, PVD process or by flame spraying. Open-pored foams are in principle commercially available and are also obtainable in a thin, fine-pored design. An example of an open-pored foam is foamed ceramic.

In one embodiment, the vaporizer has at least two layers, wherein the layers contain at least one of the following structures: a plate, foil, paper, mesh, woven structure, fabric, open-pored fiber structure, open-pored sintered structure, open-pored foam or open-pored deposition structure. For example, the vaporizer can be formed by an electric heating resistor consisting of a metal foil combined with a structure comprising a capillary structure. Such a configuration might provide a vaporizer wherein one of the surfaces of vaporizer is not exposed (due to the presence of the metal foil). Where the vaporizer is considered to be formed from a single layer, such a layer may be formed from a non-woven metal fiber fabric which, firstly, because of the electric resistance thereof, makes a contribution to the heating, and, secondly, exerts a capillary effect on the liquid material. Individual layers are advantageously but not necessarily connected to one another by a heat treatment, such as sintering or welding. For example, the vaporizer can be designed as a sintered composite consisting of a stainless steel foil and one or more layers of a stainless steel wire fabric (material, for example AISI 304 or AISI 316). Alternatively the vaporizer can be designed as a sintered composite consisting of at least two layers of a stainless steel wire fabric. Instead of sintering the layers may be connected to one another by spot welding or resistance welding. Individual layers may also be connected to one another mechanically. For instance, a double-layer wire fabric could be produced just by folding a single layer. Instead of stainless steel, use may also be made, by way of example, of heating conductor alloys-in particular NiCr alloys and CrFeAl alloys ("Kanthal") which have an even higher specific electric resistance than stainless steel. The material connection between the layers is obtained by the heat treatment, as a result of which the layers maintain contact with one another-even under adverse conditions, for example during heating by the vaporizer and resultantly induced thermal expansions.

The vaporizer may comprise, for example, an electrically conductive thin layer of platinum, nickel, molybdenum, tungsten or tantalum, said thin layer being applied to a surface of the vaporizer by a PVD or CVD process. In this case, the vaporizer may comprise an electrically non-conductive material, for example quartz glass. Alternatively, the vaporizer comprises an electric resistance material, for example carbon, or an electrically conductive or semi-conductive ceramic or a PTC material. It is particularly favorable if the electric resistance material is metallic. Metals have greater ductility than the previously mentioned materials. This property has proven advantageous in so far as the vaporizer is exposed during operation to a thermal alternating load, thus causing the induction of thermal expansions. Metals can better compensate for such thermal expansions. Furthermore, metals have a higher impact toughness by comparison. This property has proven an advantage whenever the inhalator component is exposed to impacts. Examples of suitable metallic resistance materials include: stainless steels, such as AISI 304 or AISI 316, and heating conductor alloys-in particular NiCr alloys and CrFeAl alloys ("Kanthal"), such as DIN material number 2,4658, 2,4867, 2,4869, 2,4872, 1,4843, 1,4860, 1,4725, 1,4765 and 1,4767. Suitable vaporizers are also referred to in WO 2010/045671 as composites, the entire content of which is included herein by reference.

The vaporizer may have a thickness of 1.0 mm or less, for example, 0.9 mm, 0.8 mm, 0.7 mm, 0.6 mm, or 0.5 mm. In one embodiment, the vaporizer may have a thickness of 50-300 μm. The width of the vaporizer may be from about 1 mm to about 10 mm. In one embodiment, the width of the vaporizer is selected from 1 mm, 2 mm, 3 mm, 4 mm, 5 mm, 6 mm, 7 mm, 8 mm, 9 mm or 10 mm. This dimensioning has the result that the heat introduced in the interior of the vaporizer can flow efficiently by means of heat conduction, i.e. at a low temperature gradient-to the exposed vaporizer surface where it causes evaporation of the liquid material. In addition, vapor already formed in the interior of the vaporizer can more easily reach an exposed vaporizer surface. These conditions permit a further increase in the evaporative capacity. In some embodiments, the thickness of the vaporizer corresponds substantially to the thickness of the second surface. In one embodiment, the vaporizer has a substantially uniform thickness.

In one embodiment, the vaporizer may include one or more slot-shaped recesses extending from the second surface into the first surface. The slot(s) may extend halfway across the width of the first surface. Alternatively the slot(s) may extend even further.

In one embodiment, there are multiple slots disposed along the vaporizer. The slots may be formed as cuts in the vaporizer or may be stamped/punched. Suitable slotted vaporizers are also disclosed in WO 2011/109849, the entire content of which is included herein by reference. In this regard, the presence of one or more slot-shaped recesses has the effect of restricting the flow of current through the vaporizer. This restriction leads to areas of increased heat generation around the internal apex of the slot(s). This increase in localized heat generation contributes to the creation of temperature gradients across the vaporizer. A similar effect may also be achieved by employing recesses of different dimensions (not necessarily slot-shaped) provided that such recesses have the effect of restricting the flow of current through the vaporizer and promote the creation of localized temperature gradients. A similar effect may also be achieved by replacing the slot(s)/recess(s) with an insulative material.

The longitudinal and transverse dimensions of the vaporizer are not particularly limited. In particular, the longitudinal dimension of the vaporizer may be dictated by the size of the device which incorporates the assembly and/or the orientation of the vaporizer within said assembly. For the avoidance of doubt, the longitudinal dimension/axis of the vaporizer is that which has the greatest length and does not necessarily correspond to the orientation of the vaporizer within a device. For example, the vaporizer assembly may be oriented within a device such that the longitudinal dimension of the vaporizer is perpendicular to the longitudinal dimension of the device. Alternatively, the longitudinal dimension of the vaporizer may be substantially parallel with the longitudinal dimension of the device.

Matrix

The matrix of the present disclosure is required to be suitable for retaining a vaporizable liquid. For example, the vaporizable liquid may contain substances such as nicotine, combined with one or more other components such as glycerol, water or other components as desired.

The configuration of the matrix is such that it retains the vaporizable liquid under normal environmental conditions, e.g. atmospheric pressure etc., but releases the vaporizable liquid in those areas in contact with the second surface of the vaporizer. In this regard, the matrix may have a capillary structure which, relative to the capillary structure of the vaporizer, allows for release of the vaporizable liquid when the capillary structure of the vaporizer is in contact with the capillary structure of the matrix.

Suitable materials for the matrix include non-woven fabrics (for example, Kuraflex®, Kuraray; Sontara®, DuPont), thermoplastic polyurethanes (for example, Tecophilic TPU, Lubrizol), thermoplastic copolyesters (for example Arnitel®, DSM), melamine foam, open cell polyether and polyester foams, polyolefin based open cell porous materials, printing foam, borosilicate microfiber glass filters, natural cotton wick, silica wick, viscose felt wicks, carbon felt, graphite felt, polyacrylonitrile fibers (for example, Pyron®, Zoltek), ceramic fiber (for example, Nextel®, 3M); hydrophilic polyether block amides (for example, Pebax®, Arkema), porous ceramics, and polyester cotton wick, or combinations thereof.

The matrix may be configured to have varying degrees of capillarity. For example, where the matrix is of tubular configuration, an outer portion of the matrix may have a capillary structure with larger capillary channels compared to an inner portion of the matrix. Such a configuration favors the inward progression of liquid through the capillary channels. Thus, in one embodiment, the matrix is tubular and has a capillary structure, the channels of which become progressively smaller in an inward direction. For example, where the matrix is cylindrical, concentric portions of the matrix may have relatively larger and smaller capillary channels, the portion with smaller capillary channels being disposed inwardly of the portion with larger channels.

As described above, the matrix is in contact with the vaporizer via the second surface. However, the matrix may be in contact with the vaporizer at other additional surfaces. Also, more than one matrix may be present such that at least one matrix is in contact with the second surface of the vaporizer and one or more other matrixes contact other surfaces.

As described above, the matrix will typically comprise a capillary structure which retains the vaporizable liquid under the above mentioned circumstances. So that the vaporizable liquid can be transmitted to the vaporizer, the capillary structure of the matrix needs to be exposed at least in those areas which contact the second surface of the vaporizer. The portions of the matrix that do not contact the vaporizer need not all have an exposed surface. However, it will be understood that a second surface of the matrix is generally exposed for ventilation purposes to allow air entering the capillary structure of the matrix replacing the volume of liquid that has been supplied to the vaporizer. In one embodiment, the matrix has an exposed capillary surface in those areas in which it contacts the vaporizer. As described above, "exposed" in the present context does not mean that the exposed surfaces of the matrix cannot be in contact with another component which does not form part of the matrix, e.g. the vaporizer.

The particular shape of the matrix is not limited. However, it will be appreciated that where the vaporizer and matrix are incorporated into a device, such as an e-cigarette, the shape and dimensions of the matrix should be such as to provide a device which is compact. Thus, the matrix may be distributed around other components of the device and may be shaped to conform to the required external or internal profile of the device, the only requirement being that at least a portion of the matrix is in contact with the vaporizer via the second surface. It will also be understood that a single matrix can be in contact with multiple surfaces of the vaporizer, provided of course that it is at least in contact with the second surface as defined above. In one embodiment, a matrix contacts the vaporizer via all surfaces forming a common edge with the first surface. In one embodiment, the vaporizer is only in contact with the matrix via the side surfaces, i.e. those surfaces forming a common edge with the first surface.

In one embodiment, the matrix is tubular, for example cylindrical. In this regard, where the matrix is tubular its longitudinal axis may be parallel to the longitudinal axis of any device within which it is located. In one embodiment, the longitudinal axis of the tubular matrix and associated device are substantially aligned. Where the matrix is tubular, it will be appreciated that the vaporizer may extend across the matrix so as to be in contact with opposing surfaces of the matrix. Thus, the vaporizer may form a bridge across a tubular matrix.

As explained above, more than one matrix may be in contact with the vaporizer, or a single matrix may be in contact with more than one surface of the vaporizer. For instance, where multiple matrixes are present it may be that each matrix is in contact with a surface that forms a common edge with the first surface. For example, where the vaporizer is of a rectangular shape (3 dimensional) and thus comprises six surfaces (upper, lower, first side, second side, first end, second end) the first surface of the vaporizer would correspond to the upper or lower surface (depending on orientation) and the second surface may be any one of the first or second sides or first or second ends, then one or more matrix may be in contact with the second surface of the vaporizer, and one or more matrix may be in contact with any of the remaining five surfaces of the vaporizer. In other words, at least one matrix is in contact with at least the second surface, and one or more additional matrixes can be in contact with the remaining surfaces. Typically, however, it is envisaged that at least a portion, for example the entire first surface, e.g. upper or lower surface (for a rectangular vaporizer) is not in contact with a matrix. In fact, in some embodiments said surfaces are substantially free from contact with any other component (other than electrical and fixing contacts) so as to allow for efficient evaporation and distribution of the liquid once vaporized. In one embodiment, the first surface is not in contact with a matrix. In one embodiment, any contact between the first surface of the vaporizer and the matrix is minimal. In this regard, where the matrix is formed of a resilient material it may be that the area which is in contact with the vaporizer is compressed to a small degree. This small degree of compression may cause a surface of the matrix to overhang the first surface to the extent that there is superficial contact. Such contact is considered to be insufficient to establish an efficient capillary link between the vaporizer and the matrix. Therefore in one embodiment, the first surface of the vaporizer is substantially free from contact by a matrix. Where there is an opposing surface substantially equivalent in surface area to the first surface (for example the lower face of a rectangular vaporizer where the upper surface corresponds to the first surface), the opposing surface may also not be in contact with a matrix (or be substantially free from contact as explained above). Where a matrix is in contact with the first surface, it is considered advantageous that a portion of the first surface is free from contact with the matrix, or indeed any other component of the vaporizer assembly. Such an arrangement allows for vaporized liquid to be expelled from the first surface via the capillary structure.

Accordingly, in one embodiment the vaporizer assembly comprises a first matrix in contact with the second surface of the vaporizer and a second matrix in contact with a further surface of the vaporizer, said further surface also forming a common edge with the first surface. In one embodiment, the vaporizer has a second surface and a third surface, each of which independently forms a common edge with the first surface. In one embodiment, the third surface is orientated opposite the second surface. In one embodiment, the vaporizer comprises second, third, fourth and fifth surfaces, all of which form independent common edges with the first surface. In one embodiment, the vaporizer comprises one or more surfaces which form independent common edges with the first surface. In one embodiment, the vaporizer comprises more than one surface which each form an independent common edge with the first surface. In one embodiment, the vaporizer comprises more than two surfaces which each form an independent common edge with the first surface. In one embodiment, the vaporizer comprises more than three surfaces which each form an independent common edge with the first surface. In one embodiment, the vaporizer comprises more than four surfaces which each form an independent common edge with the first surface. In one embodiment, the vaporizer comprises two, three, four, five, six, seven, eight, nine or ten surfaces, each of which forms an independent common edge with the first surface.

In one embodiment, the multiple surfaces of the vaporizer which form common edges with the first surface form planes that are substantially parallel. In other words, the angles formed between the first surface and the multiple surfaces forming common edges with the first surface are the same, or substantially the same.

It will be appreciated that numerous vaporizer and matrix configurations are possible. Indeed, multiple vaporizers may be present in the assembly, either of the same or different shape/configuration.

In one embodiment, the vaporizer assembly comprises two, three, four or more vaporizers.

Where the assembly comprises multiple vaporizers, they may be in a stacked configuration (above and below each other/in different planes), or they may be oriented in substantially the same plane. Where there are multiple vaporizers, each vaporizer may be separated by one or more matrixes (e.g. vertically or horizontally sandwiched).

In one embodiment, the vaporizer assembly comprises one vaporizer. In one embodiment, the vaporizer assembly comprises two vaporizers. In one embodiment, the vaporizer assembly comprises three vaporizers. In one embodiment, the vaporizer assembly comprises four vaporizers. As described, each vaporizer comprises at least a first and second surface and is in contact with at least one matrix via at least said second surface.

The vaporizer(s) present in the assembly may act to support one or more matrix present in the assembly. This is particularly the case when the assembly is present in a device. For example, where the vaporizer assembly is present in a device the vaporizer may be configured to retain the matrix against a surface of the device. Where multiple vaporizers are present, the vaporizers may sandwich one or more matrixes between them, thus supporting the matrixes within the device.

Likewise, the matrixes can be considered to support the vaporizer(s). Thus in one embodiment, one or more vaporizers may be supported by one or more matrixes. In particular, where the matrix is tubular, it may be formed of a resilient material and have an inner diameter slightly smaller than the length/width of the vaporizer (depending on orientation) such that the vaporizer may bridge opposing surfaces of the matrix and yet be supported by the matrix (due to the resilient nature of the matrix). Alternatively, where the matrix is not particularly resilient, it may still act to support a bridging vaporizer as the vaporizer may be attached to the matrix in other suitable ways.

The vaporizer is responsible for evaporating the liquid present in the matrix. Accordingly, the vaporizer is made of/comprises an electrically resistive material which when connected to an electrical circuit will experience an increase in temperature and thus evaporate any vaporizable substance in contact with its surface. In this regard, opposing ends of the vaporizer may be attached to respective positive and negative terminals of a power source (battery). Where multiple vaporizers are present, each may be connected individually to a power source (battery) or one or more electrically conductive bridges may join each of the vaporizers and these bridges may be in electrical contact with the relevant terminals of a battery etc. Suitable batteries for use in devices such as e-cigarettes and the like are well known to the skilled person. For example, rechargeable batteries are envisaged.

It will be appreciated that in the context of the present disclosure, "contact" between the vaporizer and the matrix via the second surface of the vaporizer is to be understood as being sufficient contact so as to allow for a sufficient capillary link to be established between the matrix and the vaporizer. Thus, "contact" insufficient to establish such a link is not considered to be "contact" in the context of the present disclosure.

As described above, in a further aspect there is disclosed a device comprising the vaporizer assembly as described herein. In one embodiment, the device may be an e-cigarette and comprise a housing, a power source (battery), the vaporizer assembly, one or more LEDs and one or more sensors to detect when the device is in use and to activate the vaporizer of the vaporizer assembly. The housing typically encompasses the other components of the device and holds them in position.

The housing typically encompasses the other components of the device and may be designed so as to provide an air channel through the device and over at least one surface of one or more vaporizers present in the device. Alternatively, the other components encompassed by the housing may be configured so as to provide an air channel through the device and over at least one surface of one or more vaporizers present in the device. Indeed, where the matrix is tubular, the inner walls of the tubular matrix may serve to form an air channel. Typically, the air channel will be arranged over at least the first surface of any vaporizer present in the device, but it may also be that the design of the housing/other components is such that air flow is directed over multiple surfaces of any vaporizers present in the device.

The housing may be separable into two or more parts. For example, where the housing is separable into two parts, the vaporizer assembly and mouthpiece may be contained in the first part and the power source, LED and sensor may be contained in the second part. Each of the parts of the housing may contain a suitable aperture to allow air flow through the device and out of the mouthpiece. Alternatively, the device may be configured such that only one of the parts of the housing, e.g. the first part, has suitable apertures. In one embodiment, the housing may be separable into three parts and in this case, the vaporizer assembly may be contained in two different parts of the housing that can be brought together to form the vaporizer assembly.

In one embodiment, the vaporizer assembly is part of a first housing and said housing includes a mouthpiece and a connector for establishing mechanical and electrical connection with a further housing part. For example, in this embodiment the first housing may form a cartomizer comprising the vaporizer assembly according to the present disclosure.

Various configurations of devices, and e-cigarettes in particular, comprising the vaporizer assembly of the present disclosure may be envisaged.

BRIEF DESCRIPTION OF THE DRAWINGS

The various aspects of the present disclosure will now be described with reference to the following embodiments. However, it is to be understood that the present disclosure is not to be limited to each specific embodiment, and indeed, the features of each embodiment may be applied to other embodiments as appropriate.

DETAILED DESCRIPTION

Figure 1A:
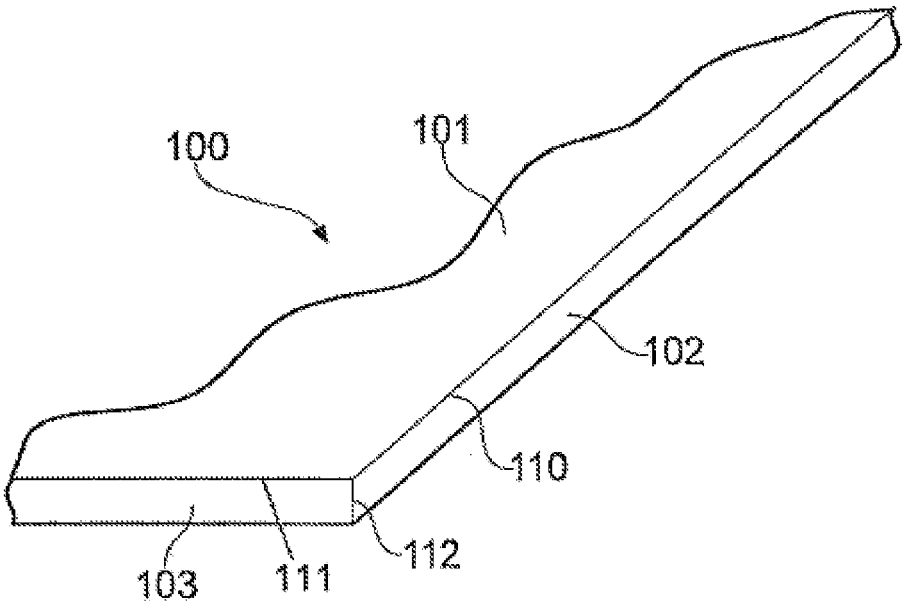
FIG. 1A—shows a perspective view of a portion 100 of a vaporizer according to the present disclosure.

FIG. 1A shows a portion of a first vaporizer 100 according to the present disclosure. The vaporizer 100 has a first surface 101 and a second surface 102. The first and second surfaces form a common edge 110. FIG. 1A also shows a further surface 103 which forms an independent common edge 111 with the first surface 101 and also forms a common edge 112 with the second surface 102. As will be appreciated from FIG. 1A, the surface area of the first surface 101 is greater than that of the second surface 102.

Figure 1B:
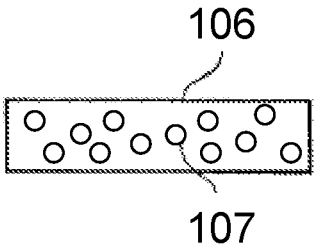
FIG. 1B—shows a perspective view of a portion 100 of a vaporizer according to the present disclosure.

Referring to FIG. 1B, the vaporizer 100 itself may be formed from a material 106 having a capillary structure 107. In this regard, and as a result of being in contact with the matrix containing a vaporizable liquid, the capillary structure 107 serves to distribute the liquid to be vaporized through the vaporizer 100. According, the capillary structure 107 may extend through the entire vaporizer 100. Alternatively, it is possible that capillary structure 107 may be localized to specific areas of the vaporizer 100.

Figure 2:
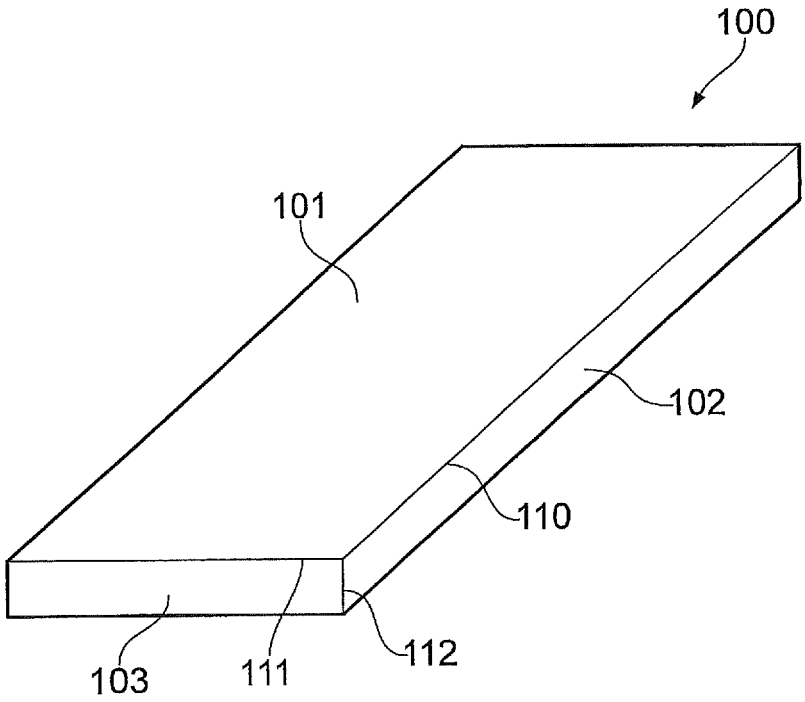
FIG. 2—shows a perspective view of a vaporizer 100 according to the present disclosure.
Figure 3A:
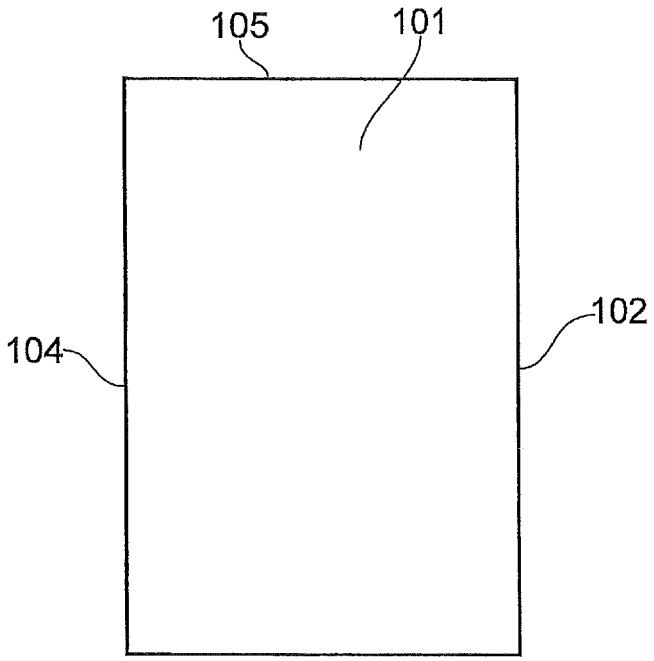
FIGS. 3A, 3B and 3C—show plan and end views of a vaporizer 100 according to the present disclosure.
Figure 3B:
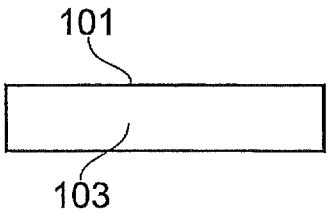
Figure 3C:
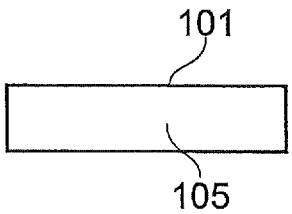

FIG. 2 shows vaporizer 100 and in this instance vaporizer 100 has a rectangular profile. It will be appreciated that the vaporizer 100 shown in FIG. 2 has four surfaces which each form independent common edges with the first surface 101. In this regard, second surface 102 and fourth and fifth surfaces 104, 105 are depicted in FIGS. 3A, 3B and 3C.

Figure 4:
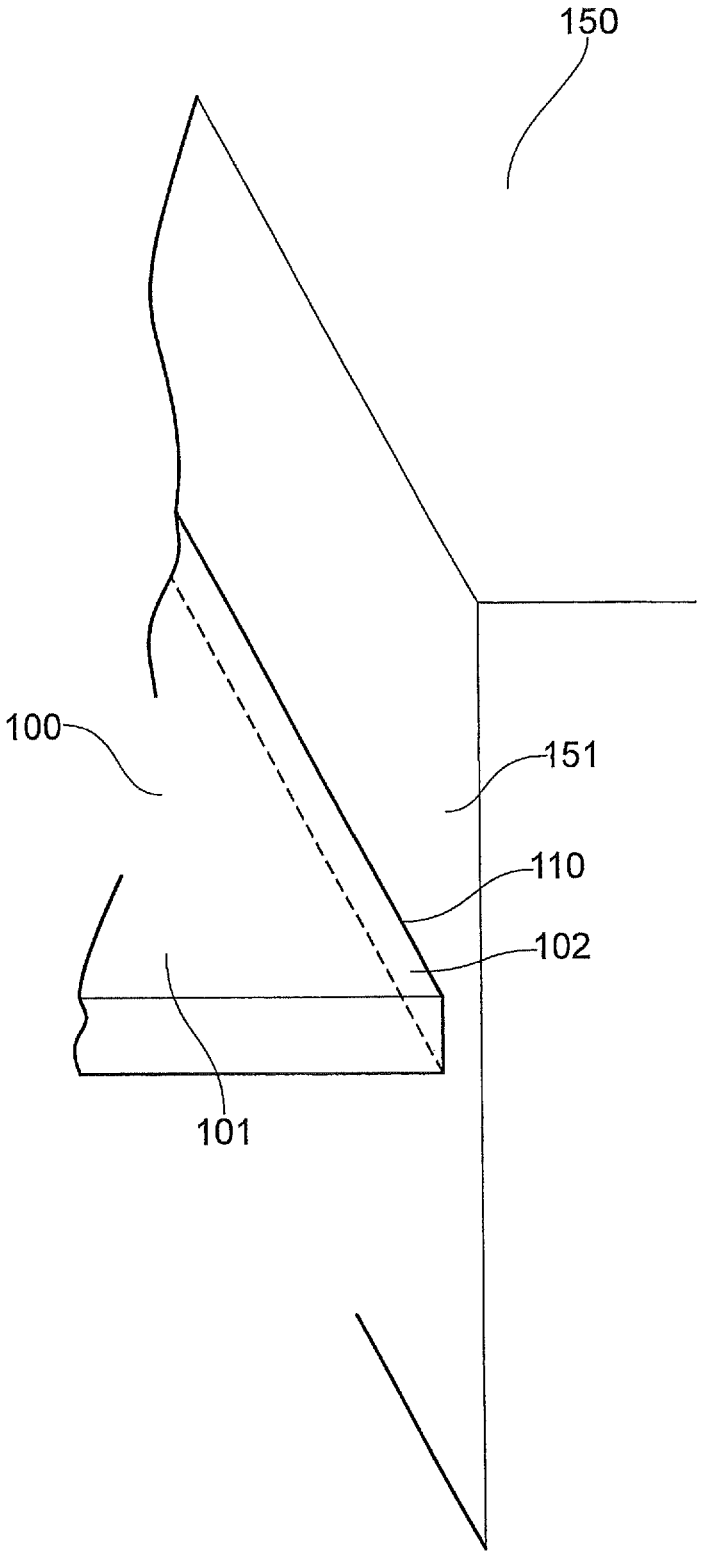
FIG. 4—shows an exemplary region of contact between a vaporizer 100 and a matrix 150.

The interaction between the vaporizer 100 and the matrix 150 is shown in FIG. 4. In particular, the matrix 150 is in contact with the vaporizer via second surface 102. More precisely, second surface 102 of vaporizer 100 contacts surface 151 of matrix 150.

Figure 5:
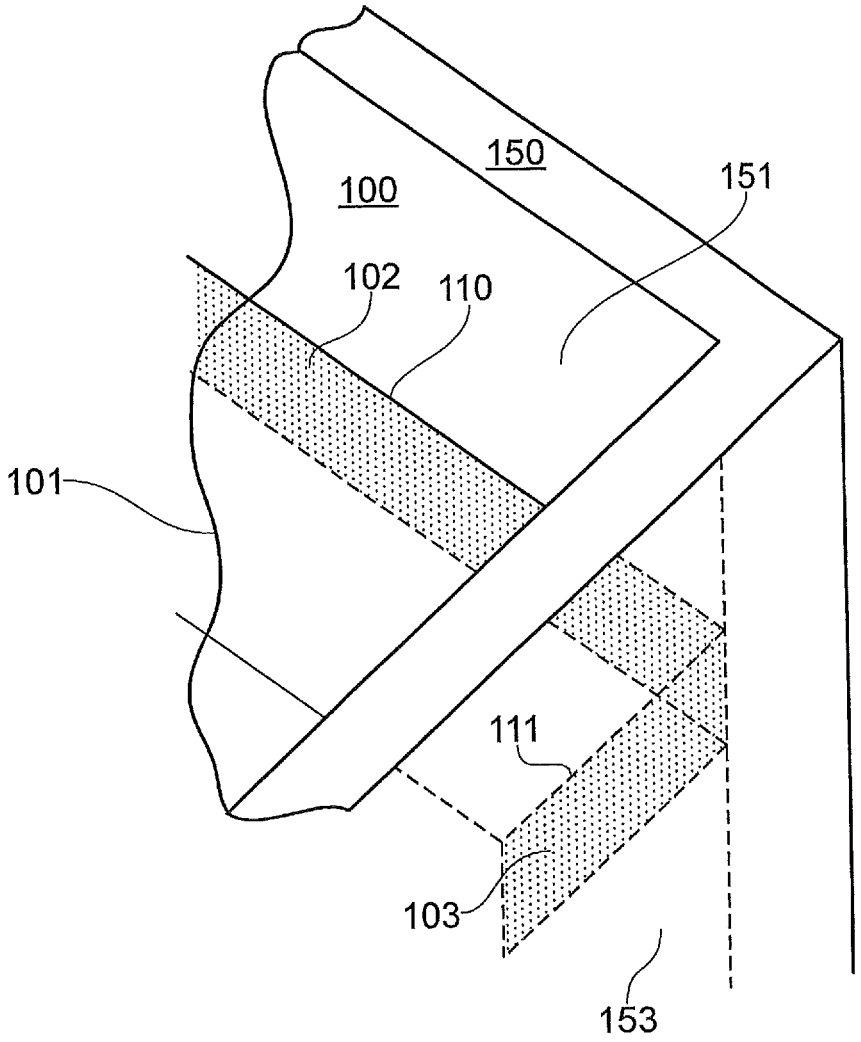
FIG. 5—shows further exemplary regions of contact between a vaporizer 100 and a matrix 150.

As described above, in some instances the matrix 150 may be in contact with more than one surface of the vaporizer 100. Such an arrangement is depicted in FIG. 5, where matrix 150 has a surface 151 in contact with the vaporizer 100 via second surface 102 as well as surface 153 in contact with the vaporizer 100 via third surface 103.

Figure 6:
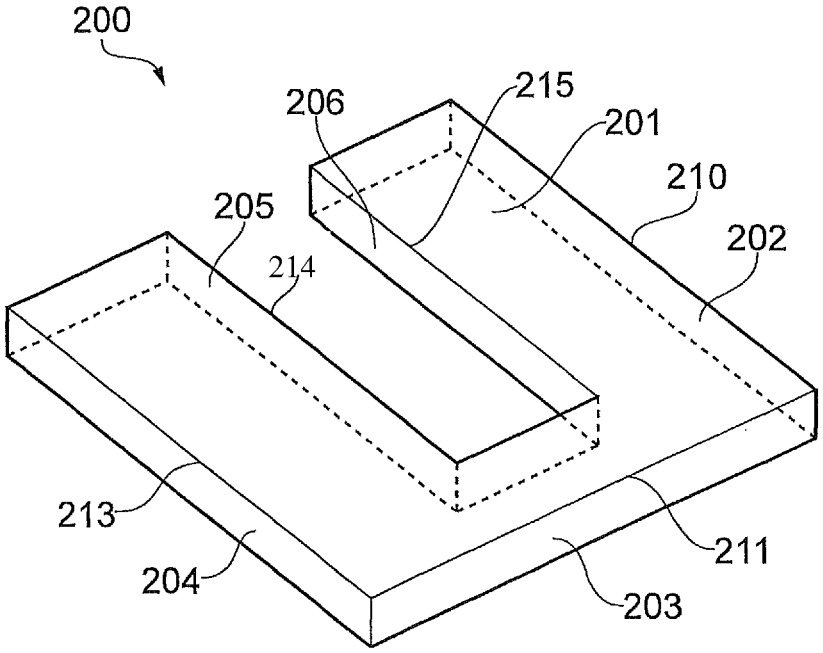
FIG. 6—shows a vaporizer 200 according to the present disclosure.

FIG. 6 shows a further vaporizer 200 which has a first surface 201, and multiple further surfaces 202, 203, 204, 205, 206 each of which independently form a common edge 210, 211, 213, 214, 215 with the first surface 201. It will be understood that any of the multiple further surfaces shown in FIG. 6 can be considered to be the second surface. Consequently, one or more matrixes may be in contact with the vaporizer via any one of the surfaces 202, 203, 204, 205, 206. As described above, a single matrix may be in contact with more than one of said surfaces and/or more than one matrix may be present and each may be in contact with one or more of said surfaces. Although not depicted in FIG. 6, the surfaces opposite to and parallel with surface 203 may also be in contact with a matrix.

It should also be noted that the matrix need not contact the entire second surface of the vaporizer assembly. However, this may be advantageous in order to establish a great degree of contact (and potentially flow of liquid) between the matrix and the vaporizer.

It will be appreciated from the above that the one or more matrixes contacts the vaporizer(s) along a "side" face, i.e. one or more of the surfaces forming a common edge with the first surface. This contact face is referred to as a "side" face owing to the configuration that results from the first surface having a surface area greater than that of the second surface. Such a configuration may be particularly advantageous as when the vaporizer is operational the liquid drawn from the matrix can be distributed substantially along the entire length of the vaporizer without compromising the evaporating efficiency of the vaporizer. Furthermore, by ensuring that contact between the vaporizer and the matrix occurs via the second surface as mentioned herein, the first surface can be left free of contact so that any liquid vaporized by the vaporizer can exit the vaporizer freely. This is typically advantageous where the vaporizer 100, 200 assembly is incorporated into devices, such as e-cigarettes, where the flow of air through the device will pass over the first surface 101,201 of the vaporizer 100,200 and thus the vapor produced by the vaporizer 100, 201 is able to form an aerosol more effectively.

Figure 7:
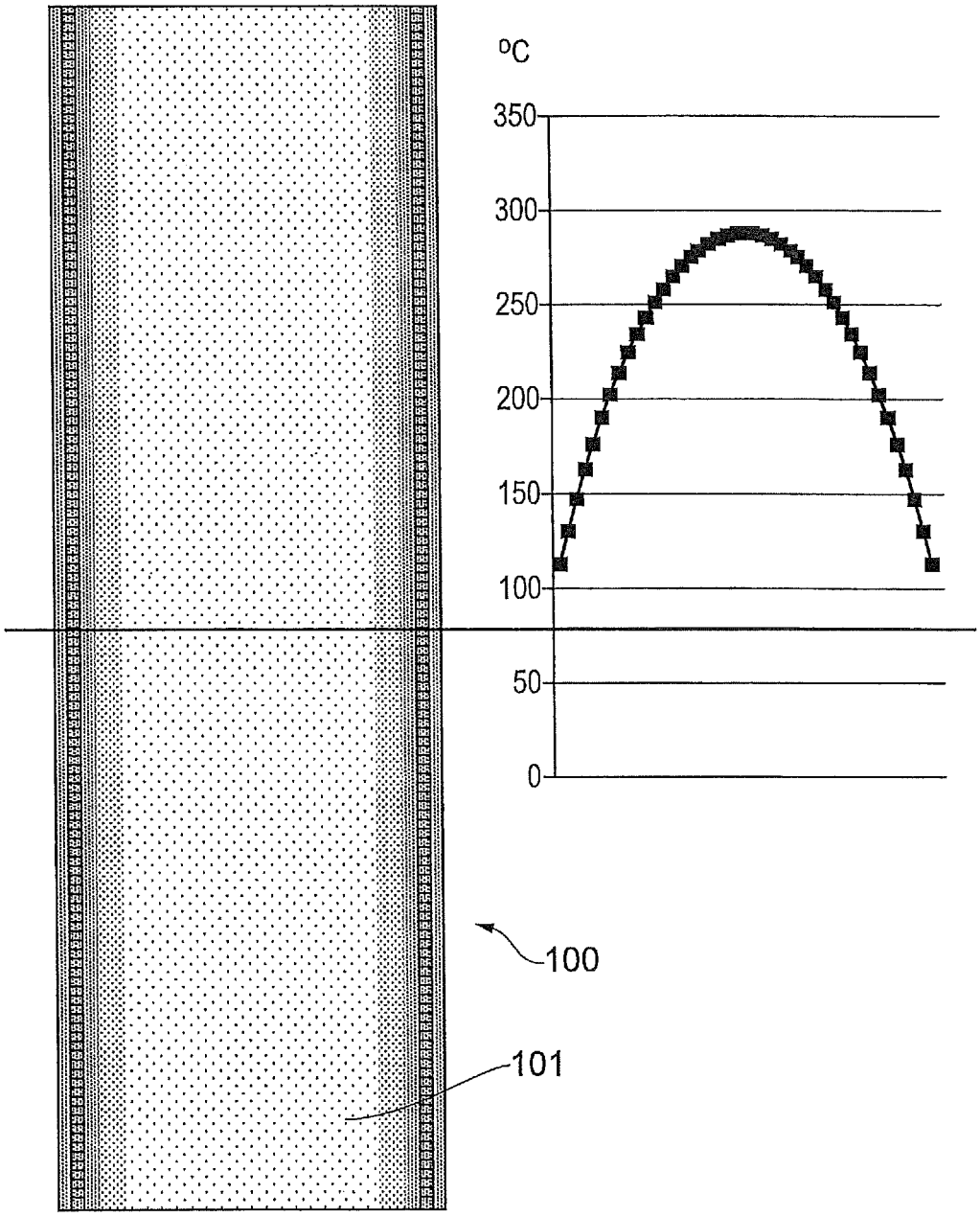
FIG. 7—shows a graphical representation of the temperature gradient formed in the vaporizer 100.

The specific orientation of the vaporizer and the matrix of the present assembly is also advantageous in that it provides for a graduated vaporization profile across the vaporizer. Due to liquid being delivered to the vaporizer via the "side" face of the vaporizer, a vaporization or temperature gradient is established across the width of the vaporizer 100,200. Without being bound by theory, this gradient is formed at least in part because of the greater proximity of the second (side) surface of the vaporizer to the matrix compared to the centre of the vaporizer. The relative flow of liquid through this portion of the vaporizer is therefore greater than towards the centre of the vaporizer and therefore the temperature of the vaporizer in these areas is depressed to a greater extent. Furthermore the unheated and usually more voluminous matrix forms a heat sink for the heated vaporizer. This vaporization gradient is particularly advantageous if the liquid to be vaporized contains multiple substances having different boiling points. The natural action of the capillary structure formed in the vaporizer 100, 200 will draw the liquid inwards from the matrix 150 via the side face (second surface as defined herein) and as a result of the vaporization gradient the vaporizer simultaneously evaporates multiple substances having different boiling points. For example, where the liquid to be vaporized contains nicotine, water and glycerol, each of which has a different boiling point, each substance can be vaporized substantially simultaneously leading to an aerosol with a more balanced profile. An example of the gradient established across the vaporizer 101 is shown in FIG. 7. It will be appreciated that this gradient is generally established when the vaporizer is configured to be fed with a vaporizable liquid in a direction substantially perpendicular to the longitudinal axis of the vaporizer.

Figure 8:
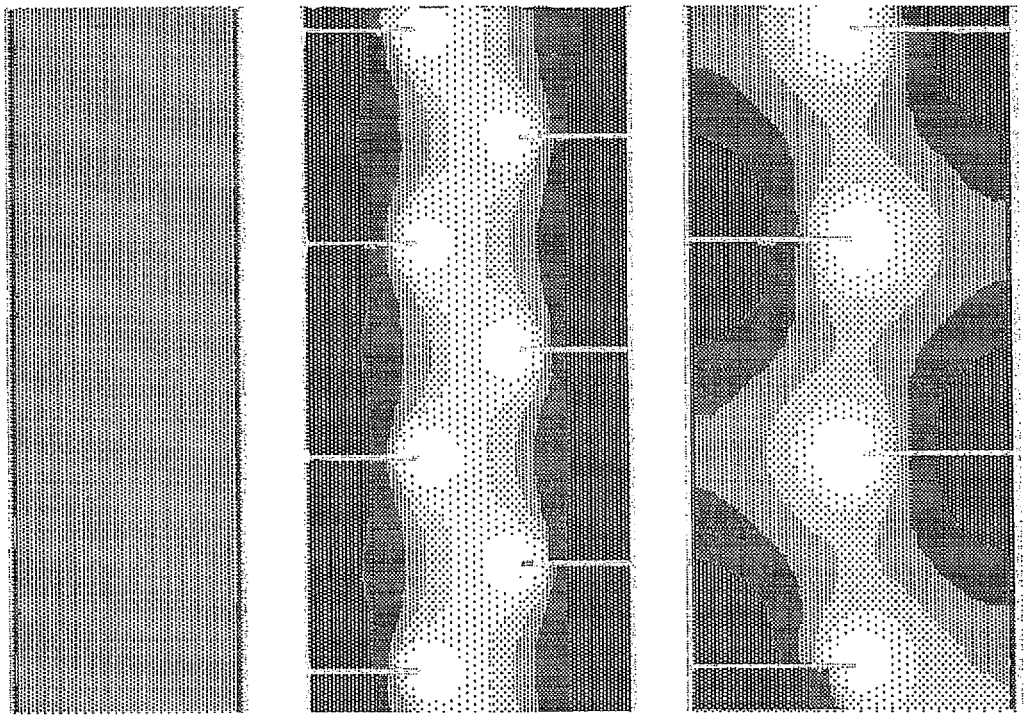
FIG. 8—shows the distribution of the electric power released across vaporizers according to the present disclosure containing no slots (left), 7 slots (middle) and 4 slots (right).
Figure 9:
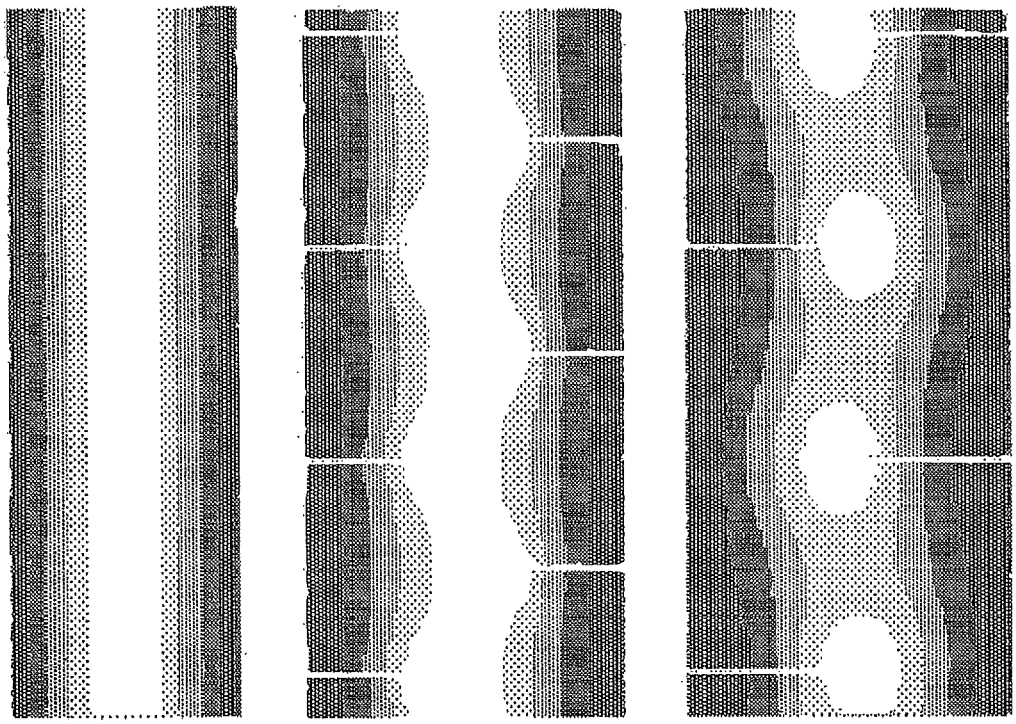
FIG. 9—shows the relative temperature distribution and gradients of the vaporizers shown in FIG. 8.

As described above, the vaporizer of the present disclosure may include one or more slots extending from the second surface of the vaporizer into the first surface. Vaporizers having such slots are shown in FIGS. 8 and 9, alongside a vaporizer having no such slots. As can be seen from FIGS. 8 and 9, the electrical power (power distribution) is influenced by the presence of the slots. When no slots are present, the electrical power generated and energy released across the device/vaporizer surface 101 is substantially constant Such a uniform generation of power/release of energy does not, however, lead to a constant temperature profile across the vaporizer as a result of the orientation of the vaporizer and matrixes, as explained above and shown in FIG. 7. The temperature gradient induced in the vaporizer is shown again in FIG. 9.

However, when one or more slots are included in the vaporizer, as for example shown in FIGS. 8 and 9, the generation of electrical power/release of energy is not constant across the vaporizer and instead peaks around the tips of the slots. These peaks in the generation of electrical power release of energy arise due to the disruption of the electrical current flowing longitudinally through the vaporizer and they lead to areas of increased temperature. This can be seen in FIG. 9, where in addition to the temperature gradient induced by the arrangement of the vaporizer and the matrixes, a further re-enforcing temperature gradient is induced. The provision of slots helps keeping the generation of power/release of energy away from the second surface, where the energy would otherwise (no slots) be immediately absorbed by the matrix which—as explained above—can be considered as a heat sink. As a result the slots are increasing the evaporation efficiency.

Figure 10:
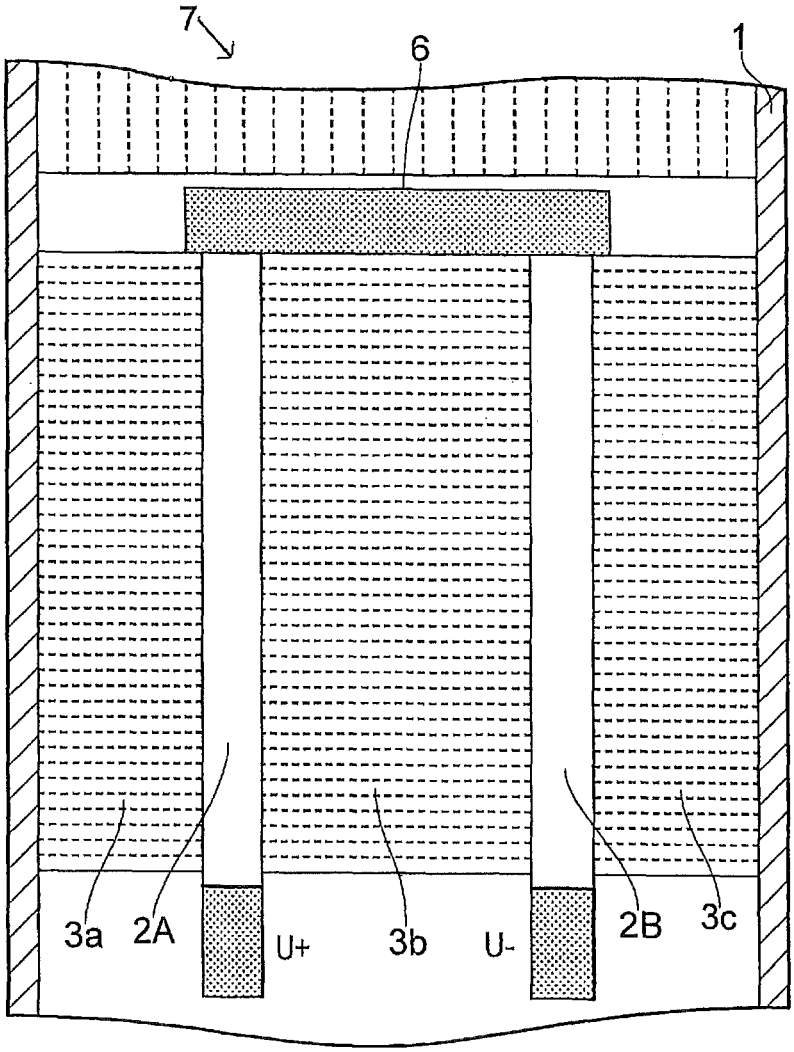
FIG. 10—shows a plan view of a device 7 incorporating a vaporizer assembly according to the present disclosure.

As described above, the vaporizer assembly may contain more than one matrix. In particular, FIG. 10 depicts a device 7, such as an e-cigarette, comprising a vaporizer assembly comprising first and second vaporizers 2A, 2B, each vaporizer being in contact with a respective matrix 3*a*, 3*b*, 3*c* via multiple surfaces of the vaporizer, each surface forming an independent edge with the respective first surface of each vaporizer. More precisely, matrix 2A is in contact with vaporizer 3*a* via a second surface of the vaporizer 2A, the second surface forming a common edge with the first surface of the vaporizer 2A. Further, matrix 3*b* is also in contact with vaporizer 2A via a further surface, the further surface forming an independent common edge with the first surface of the vaporizer 2A. Additionally, matrix 3*b* is in contact with vaporizer 2B via a second surface of the vaporizer 2B, the second surface forming a common edge with the first surface of the vaporizer 2B. Further, vaporizer 2B is also in contact with matrix 3*c* via a further surface, the further surface forming an independent common edge with the first surface of the vaporizer 2B. In this way, multiple vaporizers can cooperate with multiple matrixes in the vaporizer assembly so as to provide mutual support and efficient supply of liquid to the vaporizers.

As described above, the vaporizers 100, 2A, 2B, 200 may include portions at the distal and proximal ends which are adapted to provide electrical contacts. These portions of the vaporizers are depicted in FIG. 10 as U+ and U−. Furthermore, in some embodiments, a bridge 6 is present which provides electrical communication between multiple vaporizers so as to simply any electrical connections that may be required.

Figure 11:
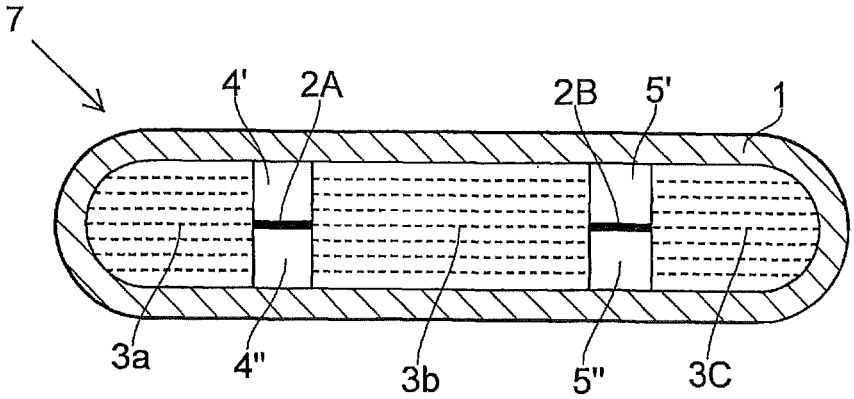
FIG. 11—shows a cross section view of the device 7 of FIG. 10.

FIG. 11 shows a cross-sectional profile of device 7 (transverse to the longitudinal dimension of the device). As explained above, device 7 includes vaporizers 2A and 2B, matrixes 3*a*, 3*b*, 3*c*, and channels 4', 4" formed above and below vaporizer 2A and channels 5', 5" formed above and below vaporizer 2B. Said channels are formed by the upper and lower major surfaces of the vaporizers, the side surfaces of the matrixes 3*a*, 3*b*, and 3*c*, as well as the inner walls of housing 1.

As described above, such an arrangement allows the vaporizers to cooperate with multiple matrixes in the vaporizer assembly so as to provide mutual support, efficient supply of liquid to the vaporizers and also the ability to form vaporization gradients across each vaporizer whilst at the same time ensuring that the first surfaces (upper surfaces as depicted in FIG. 11) remain substantially or completely contact free. This ensures efficient provision of vapor to any air channel formed above the vaporizers. Of course, the same applies to the surfaces (lower surfaces as depicted in FIG. 11).

The device 7 encloses the vaporizers and matrixes by a device wall 1. The device wall 1, also referred to as a housing, may encompasses/defines other features/components typically found in e-cigarettes: a mouthpiece; an air inlet and air outlet interconnected by channels 4', 4", 5', 5"; a battery; a PCB, various sensors and microprocessors used to operate the device in response to use of the device (e.g. inhalation though the mouthpiece); and one or more LEDs. The device 7 depicted in FIG. 11 is not intended to be limiting and any combination of vaporizers and matrixes as described herein can be incorporated into a suitable device.

Device 7 is generally operated as follows. A user places the mouthpiece of the device to his/her mouth and inhales, thereby causing air to flow through the device. Said air flow (or reduced pressure) is detected by the sensor in the device, which then relays information to the microprocessor that the device is in use. Power is then delivered to the vaporizer and, owing to the electrical resistance of the vaporizer, the temperature of the vaporizer increases. Due to the capillary effect induced by the capillary structures of the vaporizer and matrix and due to the contact between the vaporizer and the matrix (which contains a liquid to be vaporized) liquid is drawn by capillary force from the matrix to the vaporizer. Accordingly, as the temperature of the vaporizer increases various substances contained within the vaporizable liquid are vaporized. As described above with regard to FIG. 7, owing to the contact of the vaporizer with the matrix via the second surface, a temperature gradient is set-up across the vaporizer. In particular, the temperature of the vaporizer generally increases away from a surface in contact with the matrix. Therefore, with regard to device 7, each vaporizer 2A and 2B will display a greater temperature at its center compared to the temperature at the surface in contact with the respective matrixes 3*a*, 3*b* and 3*c*. During operation of the device, vapor is expelled from the vaporizers 2A and 2B into the channels 4', 4", 5' and 5". Air flowing through the device 7 also travels through channels 4', 4", 5' and 5" and as a result mixes with the expelled vapor. The vapor cools and condenses to form an aerosol which travels through the device 7 to the mouthpiece and is inhaled by the user. As vapor is expelled from the vaporizers 2A and 2B, further liquid is drawn from the matrixes 3*a*, 3*b* and 3*c* and the volume of liquid present inside the vaporizer is replenished. Once the users ceases inhalation, the sensor within the device detects the relative change in flow (or pressure) and communicates this to the microprocessor, following which the power to the vaporizer is terminated, the temperature of the vaporizer drops and liquid ceases to be vaporized (at least to the same extent as during operation). Alternatively, the power to the vaporizer may be terminated after a certain period of time (e.g. 2 seconds after start of inhalation) has elapsed. Following the signal from the sensor that the device 7 is in use the microprocessor may also cause other functions to be activated, such as operation of one or more LEDs etc.

Figure 12:
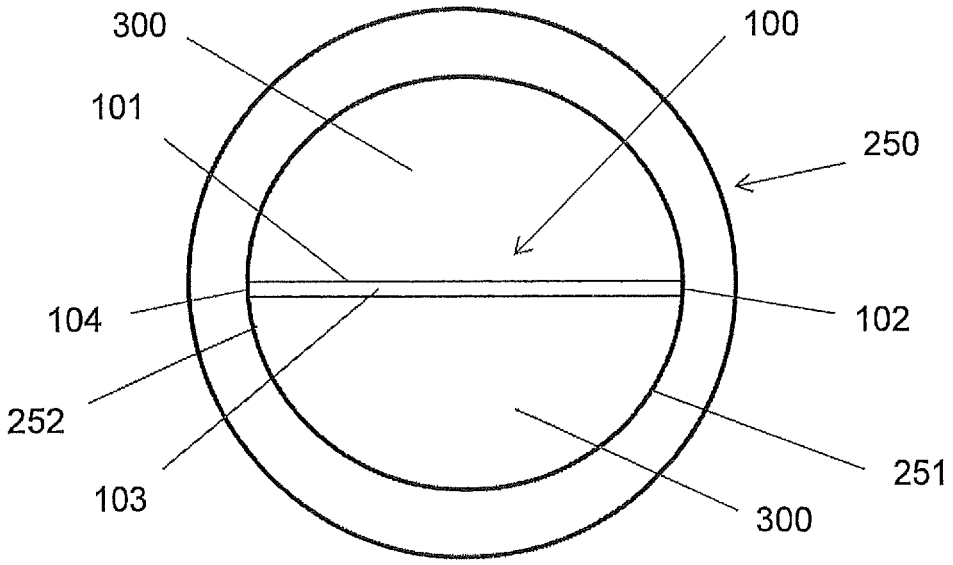
FIG. 12—shows a longitudinal cross section of a further vaporizer assembly according to the present disclosure.

A further embodiment of a vaporizer assembly according to the present disclosure is shown in FIG. 12. The vaporizer assembly depicted in FIG. 12 comprises a matrix 250 which is tubular and a matrix 100 which is dimensioned as shown in FIG. 2. In particular, vaporizer 100 has a first surface 101 and second surfaces 102 and 104. Second surfaces 102 and 104 are in contact with surfaces 251 and 252 of matrix 250. The orientation of vaporizer 100 within tubular matrix 250 is such that air channels 300 are formed above and below the vaporizer 100. Matrix 250 may be made of a resilient material. Further, the inner diameter of matrix 250 may be slightly smaller than the width of vaporizer 100 so that vaporizer 100 is supported by matrix 250 (via, for example, friction fit/the resilient nature of matrix 250).

Figure 13:
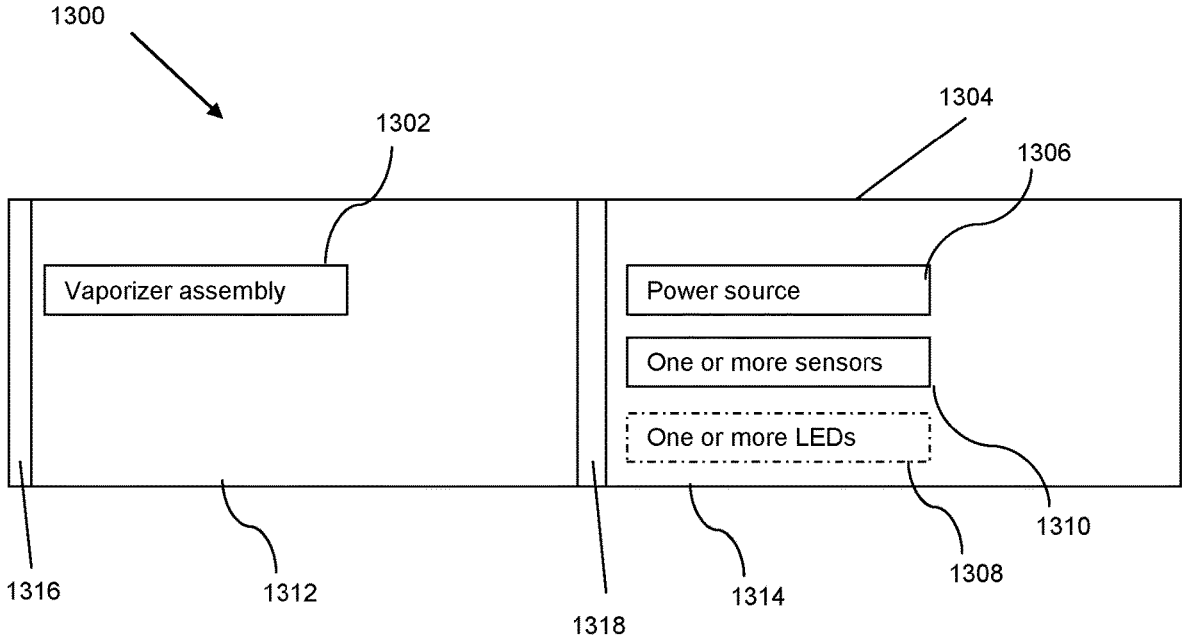
FIG. 13—shows a schematic view of a further vaporizer assembly according to the present disclosure.

FIG. 13 shows a schematic view of a further device 1300 including a vaporizer assembly 1302 according to the present disclosure. The embodiment shown in FIG. 13 includes a power source 1306, one or more sensors 1310; and optionally one or more LEDs 1308, a first part and second part of a housing (1312 and 1314, respectively), a mouthpiece 1316, and a connector 1318 for establishing mechanical and electrical connection according to the present disclosure.

The housing 1304 may be separable into two or more parts. For example, as shown in FIG. 13, where the housing 1304 is separable into two parts 1312 and 1314, the vaporizer assembly 1302 and mouthpiece 1316 may be contained in the first part 1312 while the power source 1306, LED 1308, and one or more sensors 1310 may be contained in the second part 1314. Each of the parts (1312, 1314) of the housing 1304 may contain a suitable aperture (not shown) to allow air flow through the device 1300 and out of the mouthpiece 1316. Alternatively, the device 1300 may be configured such that only one of the parts of the housing, e.g. the first part 1312, has suitable apertures. In an alternative embodiment, the housing may be separable into three parts and in this case, the vaporizer assembly may be contained in two different parts of the housing that can be brought together to form the vaporizer assembly.

In embodiments, such as the embodiment shown in FIG. 13, the vaporizer assembly 1302 is part of a first housing part 1312 and said housing part 1312 includes a mouthpiece 1316 and a connector 1318 for establishing mechanical and electrical connection with a further housing part 1314. For example, in this embodiment the first housing may form a cartomizer comprising the vaporizer assembly according to the present disclosure.

Figure 14:
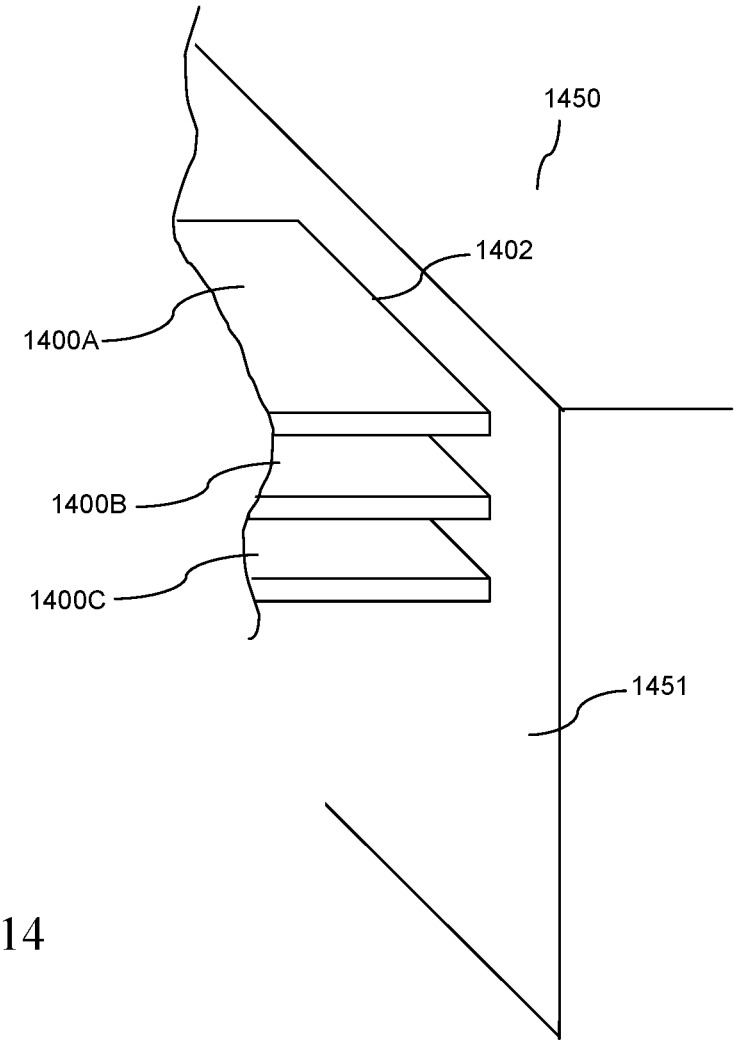
FIG. 14—shows a stacked configuration of vaporizer according to the present disclosure.

As shown in FIG. 14, where the assembly comprises multiple vaporizers 1400A, 1400B, and 1400C, they may be in a stacked configuration (above and below each other/in different planes), or in alternative embodiments they could be oriented in substantially the same plane. Where there are multiple vaporizers 1400A, 1400B, and 1400C, each vaporizer may be separated by one or more matrixes (e.g. vertically or horizontally sandwiched), in embodiments.

The interaction between the vaporizers 1400A-1400C and the matrix 1450 is also shown in FIG. 14, and is substantially similar to the arrangement described above with respect to FIG. 4. In particular, the matrix 1450 is in contact with the vaporizers (1400A-1400C) via second surfaces thereof, such as second surface 1402 corresponding to vaporizer 1401A.

The second surfaces of the vaporizer 1400A-1400C each contact the surface 1451 of matrix 1450.

All publications mentioned in the above specification are herein incorporated by reference. Various modifications and variations of the described vaporizer assembly and device incorporating the same will be apparent to those skilled in the art without departing from the scope and spirit of the disclosure. Although the invention has been described in connection with specific embodiments, it should be understood that the invention as claimed should not be unduly limited to such specific embodiments. Indeed, various modifications of the described modes for carrying out the invention which are apparent to those skilled in the art or related fields are intended to be within the scope of the following claims.

The invention claimed is:

1. A vaporizer assembly comprising a vaporizer and a matrix suitable for retaining a vaporizable liquid, wherein the vaporizer comprises:

first and second surfaces forming a common edge, the first surface having a greater surface area than the second surface, the second surface presenting along a longitudinal dimension of the vaporizer and the first surface presenting along a transverse dimension of the vaporizer;

wherein the vaporizer is in contact with the matrix via the second surface, wherein the vaporizer is formed from a material comprising a capillary structure, wherein the longitudinal dimension of the vaporizer is substantially parallel with a longitudinal dimension of the vaporizer assembly, the capillary structure being exposed along the first and second surfaces of the vaporizer.

2. The vaporizer assembly according to claim 1, wherein the vaporizer is substantially planar.

3. The vaporizer assembly according to claim 1, wherein the vaporizer has a substantially uniform thickness.

4. The vaporizer assembly according to claim 1, wherein the assembly comprises a plurality of vaporizers.

5. The vaporizer assembly according to claim 4, wherein the plurality of vaporizers are in a stacked configuration.

6. The vaporizer assembly according to claim 4, wherein the plurality of vaporizers are oriented in substantially the same plane.

7. The vaporizer assembly according to claim 1, wherein the vaporizer is supported by one or more matrixes.

8. The vaporizer assembly according to claim 1, wherein the capillary structure is exposed on all surfaces of the vaporizer.

9. The vaporizer assembly according to claim 1, wherein the capillary structure is not exposed on at least one surface of the vaporizer.

10. The vaporizer assembly according to claim 1, wherein the matrix does not contact the first surface.

11. The vaporizer assembly according to claim 1, wherein the matrix is made of a resilient material.

12. The vaporizer assembly according to claim 1, wherein the matrix contacts the vaporizer via all surfaces forming a common vertex with the first surface.

13. The vaporizer assembly according to claim 1, wherein the matrix contains a vaporizable liquid comprising at least one of nicotine, water, or glycerol.

14. A device comprising the vaporizer assembly of claim 1.

15. The device according to claim 14, further comprising:

a housing;

a power source arranged within the housing and configured to supply power to the vaporizer;

one or more sensors arranged within the housing and configured to activate the vaporizer when the device is in use; and optionally one or more LEDs.

16. The device according to claim 15, wherein the housing is comprised of a first part and a second part and the vaporizer assembly is contained in the first part.

17. The device according to claim 14, wherein the device further comprises:

a first housing comprising a mouthpiece; and a connector for establishing mechanical and electrical connection between the first housing and a second housing comprising a power source, the power source configured to supply power to the vaporizer.

18. The vaporizer assembly as claimed in claim 1, the vaporizer being formed from a porous material.

19. A vaporizer assembly comprising a vaporizer and a matrix suitable for retaining a vaporizable liquid, wherein the vaporizer comprises:

first and second surfaces forming a common edge, the first surface having a greater surface area than the second surface;

wherein the vaporizer is in contact with the matrix via the second surface, wherein the vaporizer is formed from a material comprising a capillary structure, wherein a longitudinal dimension of the vaporizer is substantially parallel with a longitudinal dimension of the vaporizer assembly, and wherein the vaporizer has a third surface forming an independent common edge with the first surface, the third surface also being in contact with the matrix.

20. The vaporizer assembly according to claim 19, wherein the third surface is positioned opposite the second surface.

21. The vaporizer assembly according to claim 19, wherein the third surface is positioned perpendicularly relative to the second surface.

22. The vaporizer assembly according to claim 21, wherein the third surface and the second surface form a common edge.

23. The vaporizer assembly according to claim 19, wherein the assembly comprises more than one matrix.

24. The vaporizer assembly according to claim 23, wherein the second surface of the vaporizer is in contact with a first matrix and the third surface of the vaporizer is in contact with a second matrix.

* * * * *